US008111203B2

(12) United States Patent
Sato

(10) Patent No.: US 8,111,203 B2
(45) Date of Patent: Feb. 7, 2012

(54) ANTENNA APPARATUS

(75) Inventor: Kyuichi Sato, Oga (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 374 days.

(21) Appl. No.: 12/413,750

(22) Filed: Mar. 30, 2009

(65) Prior Publication Data

US 2010/0134381 A1 Jun. 3, 2010

(30) Foreign Application Priority Data

Nov. 28, 2008 (JP) ..... 2008-303713

(51) Int. Cl.
*H01Q 1/32* (2006.01)
*H01Q 1/12* (2006.01)

(52) U.S. Cl. ..... 343/713; 343/715; 343/878; 343/888

(58) Field of Classification Search ..... 343/713, 343/715, 900, 906, 878, 888
See application file for complete search history.

(56) References Cited

U.S. PATENT DOCUMENTS

| | | | | |
|---|---|---|---|---|
| 4,282,526 | A * | 8/1981 | Alf et al. | 343/715 |
| 5,661,497 | A * | 8/1997 | Calearo | 343/715 |
| 6,509,878 | B1 * | 1/2003 | Tornatta et al. | 343/715 |
| 2008/0272979 | A1 * | 11/2008 | Kupek et al. | |

FOREIGN PATENT DOCUMENTS

| | | | |
|---|---|---|---|
| CN | 1 909 282 | A * | 2/2007 |
| DE | 27 08 594 | A1 * | 8/1978 |
| DE | 30 10 129 | A1 * | 10/1981 |
| DE | 10 2005 051 190 | B3 * | 2/2007 |
| DE | 102005038169 | A1 | 2/2007 |
| DE | 20 2007 015 756 | U1 * | 3/2008 |
| EP | 0 891 001 | B1 * | 4/2003 |
| EP | 1 375 256 | B1 * | 8/2008 |
| FR | 2 657 466 | A3 * | 7/1991 |
| FR | 2 657 467 | A1 * | 7/1991 |

OTHER PUBLICATIONS

German Office Action dated Jul. 21, 2009 (3 pages), and English translation thereof (2 pages), issued in counterpart German Application Serial No. 10 2009 014 775.6-55.*

German Office Action dated Jan. 21, 2010 and English translation thereof issued in a counterpart German Application No. 10 2009 014 775.6-55.

* cited by examiner

*Primary Examiner* — Hoang V Nguyen
(74) *Attorney, Agent, or Firm* — Holtz, Holtz, Goodman & Chick, PC

(57) ABSTRACT

Disclosed is an antenna apparatus, including: a support member; a drum which is rotatably supported by the support member and whose outer circumference corresponds to faces of polygonal column; a case which covers the support member and the drum and which has a hole along a circumference direction of the drum; an antenna rod which extends from the outer circumference of the drum in a direction perpendicular to an axis of the drum toward an outside of the case through the hole of the case, and polyhedral faces which are provided inside the case and which are to be fitted into the outer circumference of the drum.

3 Claims, 6 Drawing Sheets

ANTENNA APPARATUS

BACKGROUND OF THE INVENTION

1. Field of the Invention

The present invention relates to an antenna apparatus, and more particularly to an antenna apparatus which has freedom in exterior design.

2. Description of Related Art

An antenna apparatus, which is mounted on a roof and the like of an automobile, is provided with an antenna rod which is in an upright position or a lying position (for example, see DE-A1-10 2005 038 169) In the antenna apparatus disclosed in DE-A1-10 2005 038 169, a male screw (5) is disposed at a base end of the antenna rod (2) A female screw (4) is disposed at a cylindrical rotary drum (3). The antenna rod is connected to the rotary drum by the male screw with the female screw. The rotary drum is rotatably attached to a case (1). An edge portion is formed between an upper end face (11) and a rear end face (12) of the case. When the antenna rod is in an upright position, the base end face of the antenna rod and the upper end face of the case are contacted so that the antenna rod is supported in an upright position. When moving the antenna rod from the upright position to the lying position, the male screw is loosened by rotating the antenna rod so that the base end face of the antenna rod is separated from the upper end face of the case. Then, the antenna rod is rotated rearward. Accordingly, the base end face of the antenna rod passes over the edge portion between the upper end face and the rear end face of the case so that the antenna rod lies rearward. Since the base end face of the antenna rod is contacted to the rear end face of the case, the antenna rod is supported in the lying position.

A disadvantage of the antenna apparatus disclosed in DE-A1-102005038169 lies in that, in order to support the antenna rod at two positions, an external face of the case needs to have polygonal shape in side view. With this structure, there is no design freedom in external shape of the case.

SUMMARY OF THE INVENTION

It is, therefore, a main object of the present invention to provide design freedom in external shape of a case of an antenna apparatus.

According to one aspect of the present invention, there is provided an antenna apparatus, including a support member; a drum which is rotatably supported by the support member and whose outer circumference corresponds to faces of polygonal column; a case which covers the support member and the drum and which has a hole along a circumference direction of the drum; an antenna rod which extends from the outer circumference of the drum in a direction perpendicular to an axis of the drum toward an outside of the case through the hole of the case; and polyhedral faces which are provided inside the case and which are to be fitted into the outer circumference of the drum.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

A preferred embodiment of the present invention will be explained below with reference to the drawings. Although the embodiment described below has various limitations which are technically preferable in order to realize the invention, the scope of the invention is not limited to what is shown in the embodiment and the drawings.

Figure 1:
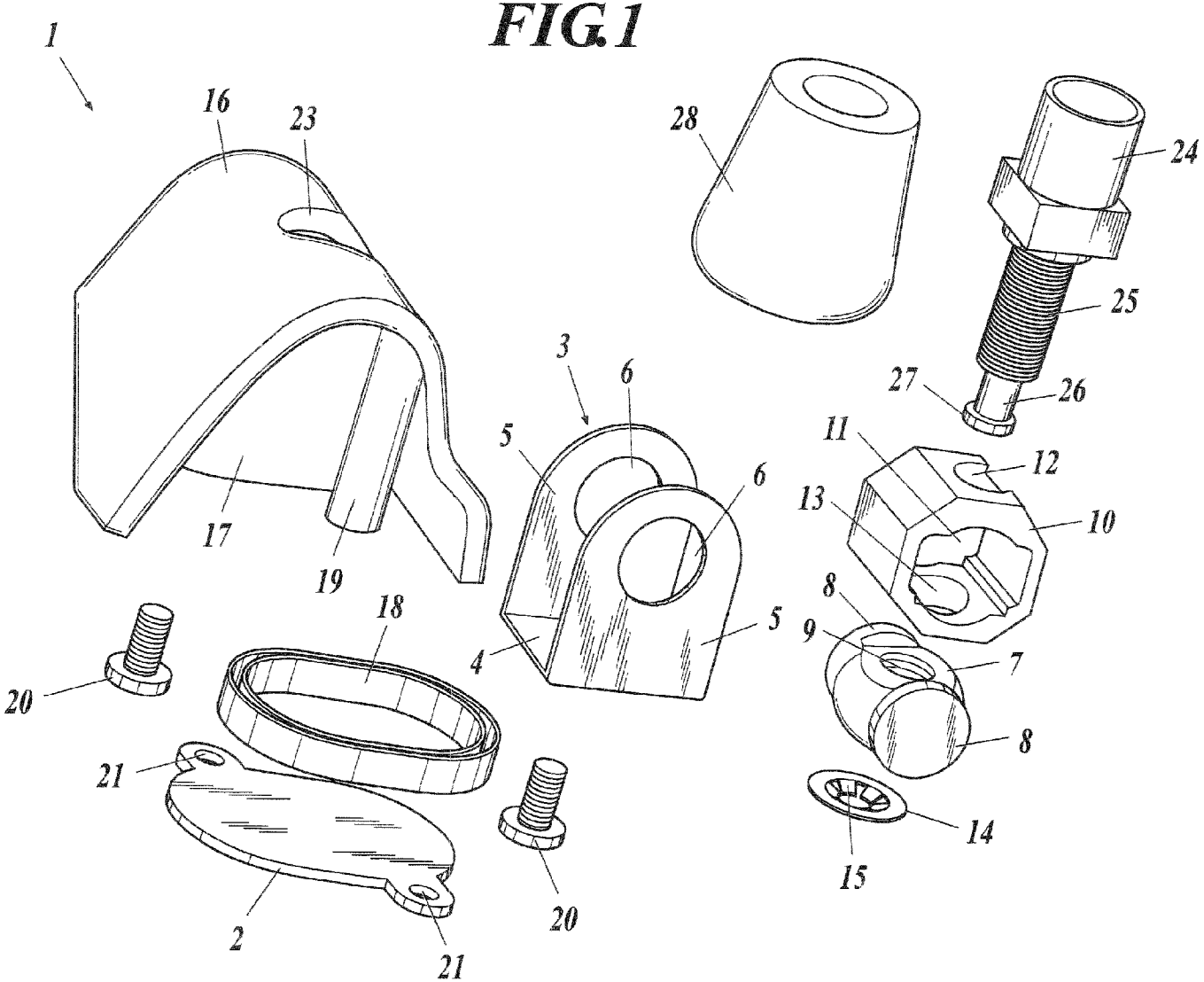
FIG. 1 is an exploded perspective view of an antenna apparatus according to a preferred embodiment of the present invention.
Figure 2:
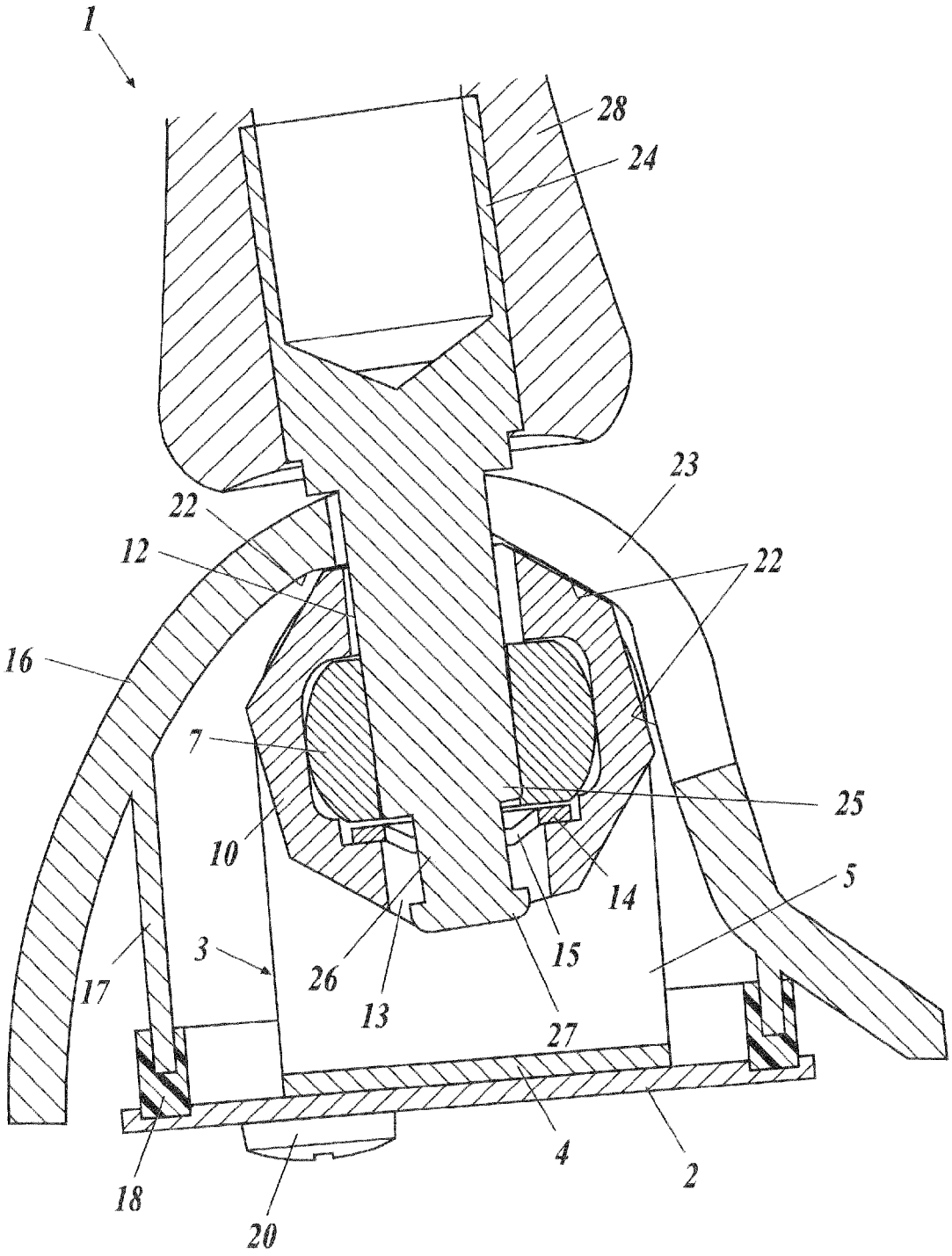
FIG. 2 is a vertical sectional view of the antenna apparatus according to the preferred embodiment of the present invention.
Figure 3:
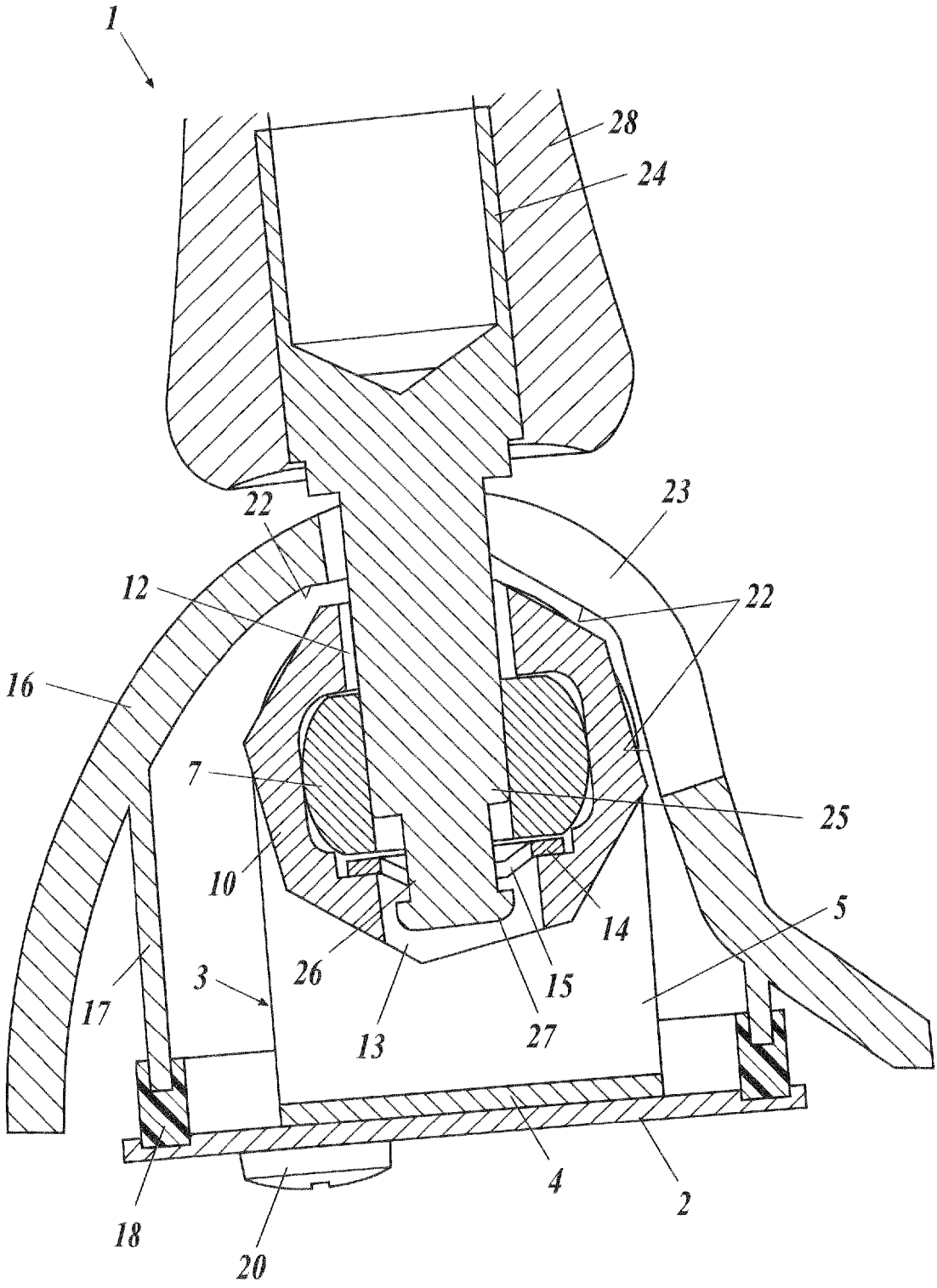
FIG. 3 is a vertical sectional view of the antenna apparatus according to the preferred embodiment of the present invention.
Figure 4:
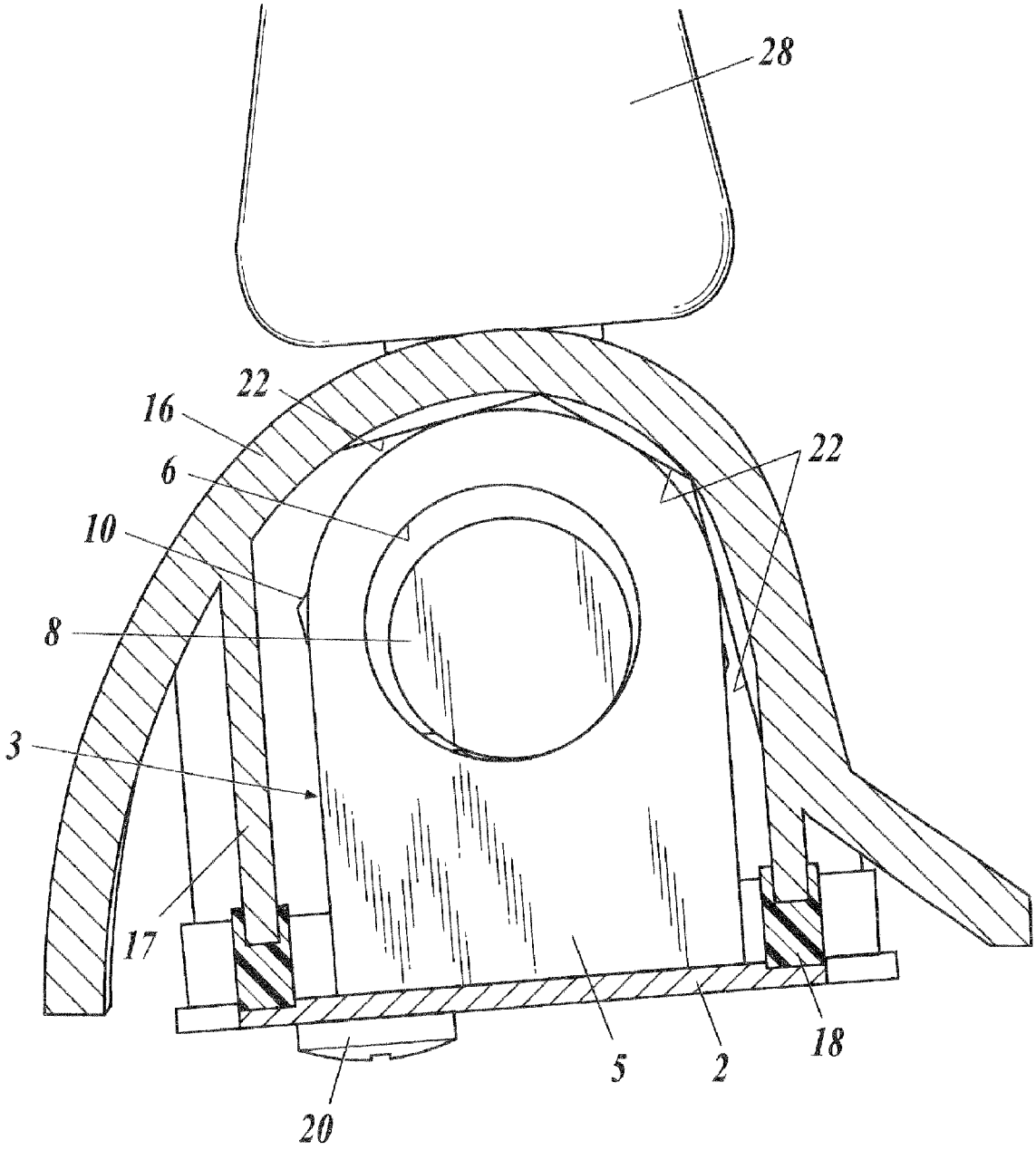
FIG. 4 is a vertical sectional view of the antenna apparatus according to the preferred embodiment of the present invention.
Figure 5:
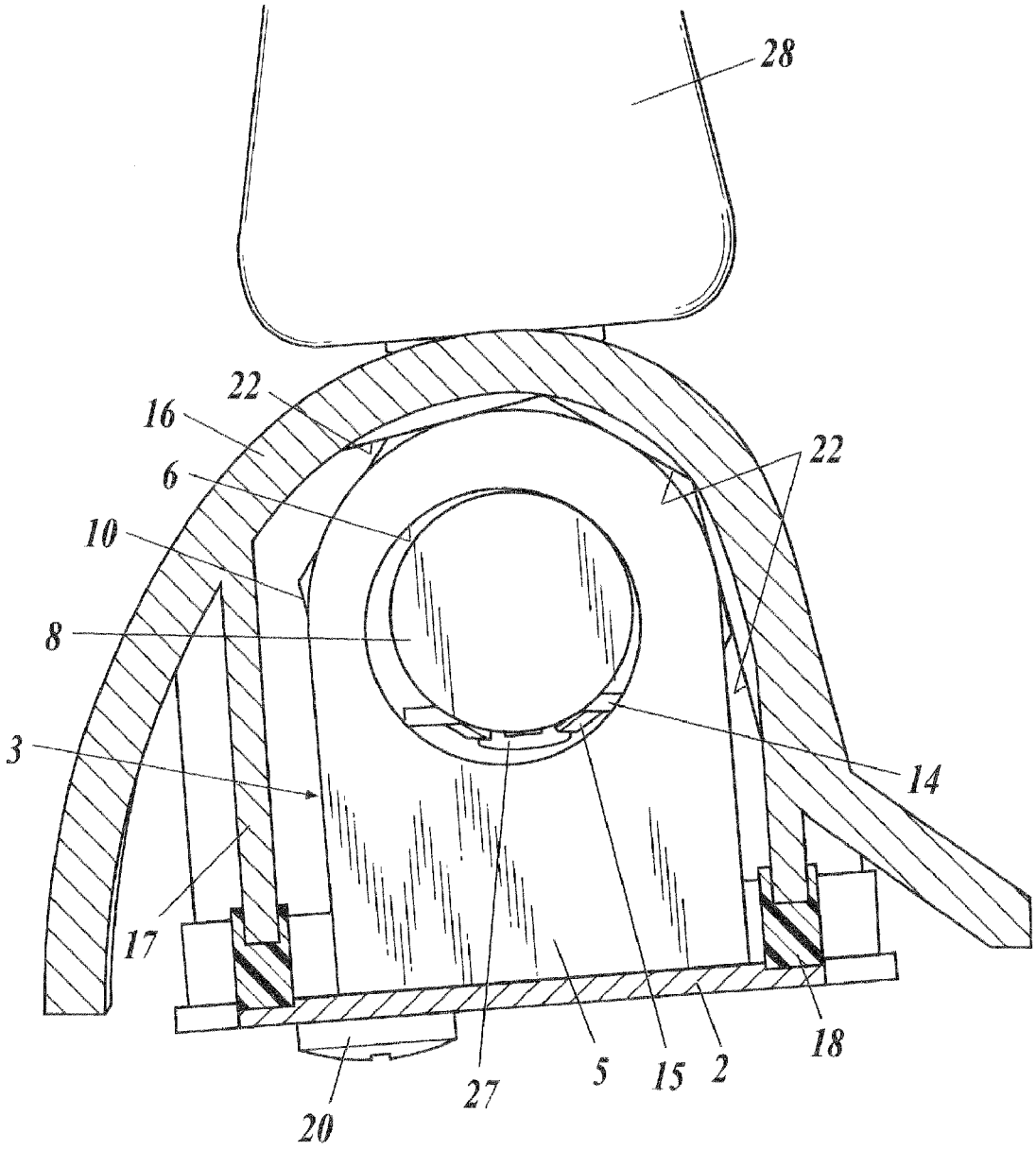
FIG. 5 is a vertical sectional view of the antenna apparatus according to the preferred embodiment of the present invention.
Figure 6:
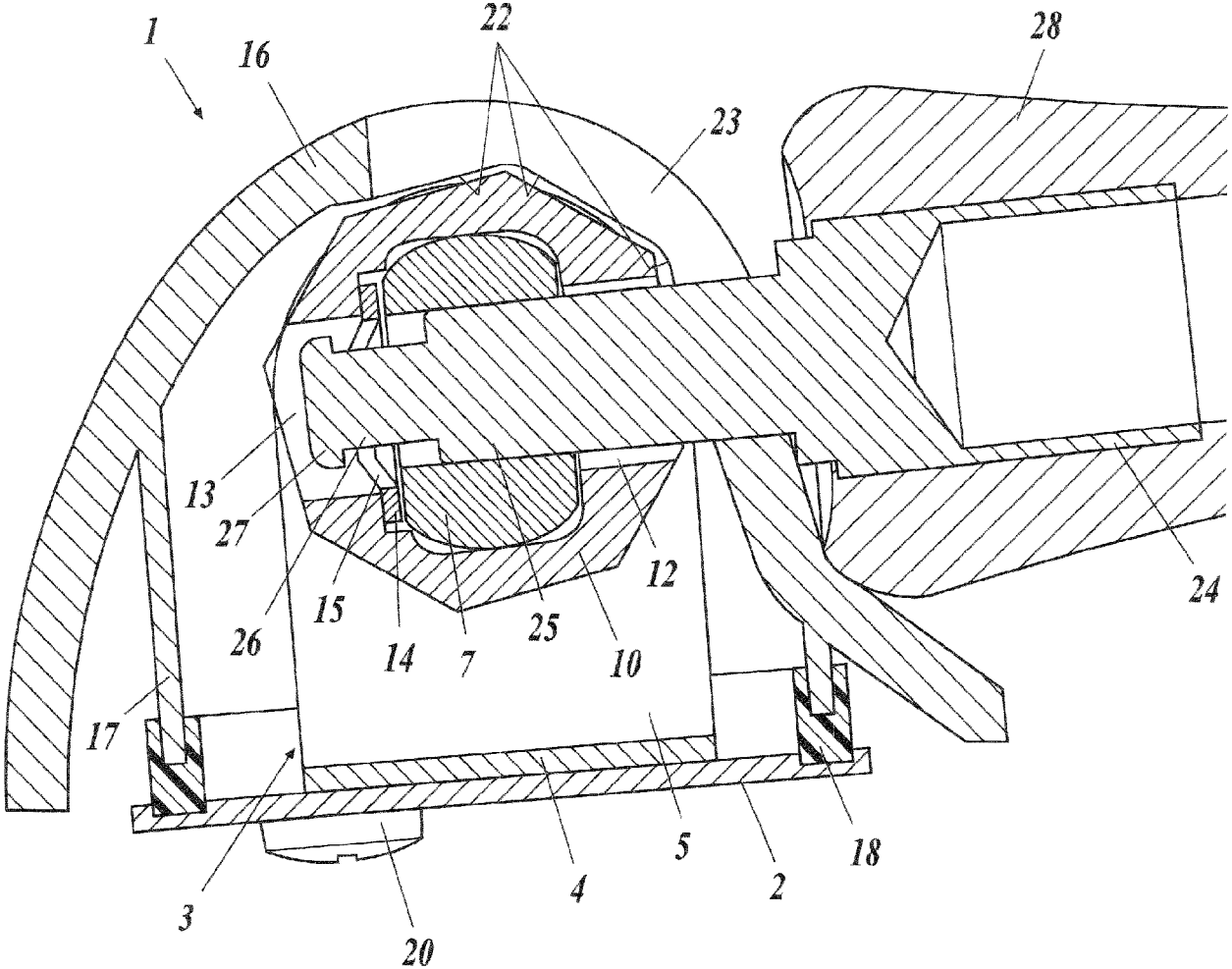
FIG. 6 is a vertical sectional view of the antenna apparatus according to the preferred embodiment of the present invention.

FIG. 1 is an exploded perspective view of an antenna apparatus 1. FIG. 2, FIG. 3 and FIG. 6 are vertical sectional views of the antenna apparatus 1. FIG. 4 and FIG. 5 are vertical sectional views of the antenna apparatus, which are different from the sectional view of FIG. 2.

A support member 3 is connected to an upper face of a plate 2. The support member 3 includes a plate-like base 4 and a pair of side boards 5. The side boards 5 are connected to the base 4 at right and left sides of the base 4 so as to stand against the base 4. A lower face of the base 4 is welded to the upper face of the plate 2. The plate 2 and the support member 3 are made of a metallic material (e.g. stainless steel) or other conductive material. A bearing hole 6 is formed at each of the side boards 5. Each bearing holes 6 is elliptically-shaped so that the long diameter extends in the vertical direction and the short diameter extends in the front-rear direction. The bearing holes 6 may be circular.

A shaft member 7 is inserted into both of the bearing holes 6. Disc-shaped shaft portions 8 are formed at both ends of the shaft member 7 and respectively fitted to the bearing holes 6. Accordingly, radial load of the shaft member 7 is received by the side boards 5 of the support member 3 and the shaft member 7 is arranged rotatable around the axis thereof. Clearance is formed between the bearing hole 6 and the shaft portion 8 so that the shaft portion 8 is loosely fitted to the bearing hole 6.

The shape of an outer edge of a section which is perpendicular to the axis at a middle part (between the shaft portions 8) of the shaft member 7 is not circular. That is, the distance from a gravity center of the section to the outer edge is not constant. Specifically, the shape of the outer edge of the section is polygonal. A screw hole 9 is formed at the middle part of the shaft member 7. The screw hole 9 penetrates the shaft member 7 along a line perpendicular to the axis of the shaft member 7. The shaft member 7 is made of a metallic material (such as stainless steel or zinc) or other conductive material.

The shaft member 7 is embraced by a drum 10. The drum 10 is formed into a polygonal column, specifically, an octagonal column. A through hole 11 penetrates the drum 10 from one end to the other end along a center line of the drum 10. The shaft member 7 is inserted into the through hole 11, and the middle part of the shaft member 7 is fitted to the through hole 11. Accordingly, the drum 10 can be rotated around the axis of the shaft member 7, together with the shaft member 7.

The drum 10 is made of a resin material, a metallic material (such as zinc die casting or brass), a ceramic material or other material. An insertion hole 12 is formed at the outer circumference of the drum 10. The insertion hole 12 penetrates from the outer circumference to the through hole 11 along a line perpendicular to the axis of the drum 10. An insertion hole 13 is also formed at the opposite side of the insertion hole 12. The insertion hole 13 penetrates from the outer circumference to the through hole 11 along the line perpendicular to the axis of the drum 10. The insertion hole 12 and the insertion hole 13 are concentric. The screw hole 9 which is formed at the shaft member 7 is also concentric with the insertion holes 12 and 13. The screw hole 9, the insertion holes 12 and 13 are arranged in a row.

In addition to the shaft member 7, a stopper ring 14 is disposed in the drum 10. The stopper ring 14 is sandwiched by the inner face of the through hole 11 around the insertion hole 13 and the middle part of the shaft member 7. The stopper ring 14 is concentric with the insertion holes 12 and 13 and the screw hole 9.

A plurality of inner teeth 15 are provided projecting from the inner edge of the spotter ring 14. With this structure, the inner diameter of the stopper ring 14 at the roots of the inner teeth 15 is larger than the inner diameter at the tip end of the inner teeth 15. The inner teeth 15 are inclined against the rest of the stopper ring 14 and extend into the insertion hole 13.

An upper case 16 is disposed over the plate 2. The external face of the upper case 16 is curved from the front face toward the rear face via the upper face. A cylindrical hood 17 is provided projecting from the inner face of the upper case 16 and directed downward, and the bottom of the hood 17 is open. A waterproof rubber 18 is attached to the bottom end of the hood 17. The bottom end of the hood 17 is disposed on an edge part of the upper face of the plate 2 so that the waterproof rubber 18 is sandwiched between the bottom end of the hood 17 and the upper face of the plate 2. A female screw cylinder 19 is formed on the inner face of the upper case 16 A screw 20 is screwed with the female screw cylinder 19 passing through a through hole 21 of the plate 2 from the lower side so that the plate 2 and the upper case 16 are assembled.

By assembling the plate 2 and the uppercase 16, the support member 3, the shaft member 7, the drum 10 and the stopper ring 14 are accommodated inside the hood 17. Polyhedral faces 22 are formed on the inner face of the upper case 16 inside the hood 17. The polyhedral faces 22 follow faces of a polygonal column with convex polygonal cross section. The outer circumference of the drum 10 matches the polyhedral faces 22.

Since the shaft portion 8 of the shaft member 7 is loosely fitted to the bearing hole 6, the outer circumference of the drum 10 can be contacted to and separated from the polyhedral faces 22 When the outer circumference of the drum 10 is contacted to the polyhedral faces 22 and is fitted to the polyhedral faces 22, the rotation of the drum 10 is deterred (see FIG. 2 and FIG. 4). On the other hand, when the outer circumference of the drum 10 is separated from the polyhedral faces 22, the drum 10 can be rotated (see FIG. 3 and FIG. 5).

The upper case 16 has a hole 23 between the upper face and the rear face thereof. The hole 23 penetrates the upper case 16 from the outer face to the inner face. The hole 23 extends in the circumferential direction of the drum 10 along an orbit of the insertion hole 12 of the drum 10 when the drum 10 is rotated.

A male screw shaft 25 is disposed at the base end of the antenna rod 24. The male screw shaft 25 extends from the base end of the antenna rod 24 along the axis of the antenna rod 24. A shaft 26 is disposed at the tip end of the male screw shaft 25. The shaft 26 extends from the tip end of the male screw shaft 25 along the axis of the male screw shaft 25. A flange 27 is disposed at the tip end of the shaft 26. The antenna rod 24, the male screw shaft 25, the shaft 26 and the flange 27 are concentric. The diameter of the shaft 26 is smaller than that of the male screw shaft 25 and that of the flange 27. The antenna rod 24 is covered by a case 28.

The base end of the antenna rod 24 is inserted into the hole 23 of the upper case 16. The male screw shaft 25 is inserted into the insertion hole 12 of the drum 10 and screwed with the screw hole 9 of the shaft member 7. The shaft 26 is inserted into the stopper ring 14. The flange 27 is inserted into the insertion hole 13 of the drum 10 and fixed by the stopper ring 14. Here, the diameter of the flange 27 is smaller than the inner diameter of the stopper ring 14 at the roots of the inner teeth 15 and is larger than the inner diameter of the stopper ring 14 at the tip ends of the inner teeth S. With this structure, the flange 27 is caught at the inner teeth 15 of the stopper ring 14. The diameter of the shaft 26 is approximately the same as the inner diameter of the stopper ring 14 at the tip ends of the inner teeth 15.

By fastening the male screw shaft 25 to the screw hole 9, the antenna rod 24 extends in the direction perpendicular to the axis of the drum 10 from the outer circumference of the drum 10. The antenna rod 24 extends outside the upper case 16 through the hole 23.

When the male screw shaft 25 is rotated around the axis thereof, the antenna rod 24, the male screw shaft 25, the shaft and the flange 27 move along the axis of the male screw shaft with respect to the drum 10 and the shaft member 7, from a position where the flange 27 is contacted to the inner teeth of the stopper ring 14 to a position where the tip end face of the male screw shaft 25 is contacted to the inner teeth 15 of the stopper ring 14.

A circuit substrate (not shown) is provided inside the upper case 16 and below the plate 2. The plate 2 and a terminal portion of the circuit substrate are electrically connected through a lead wire, a metal terminal and the like.

The working of the antenna apparatus 1 having the above-described structure will be explained below.

When rotating the antenna rod 24 around the axis thereof, the male screw shaft 25 is fastened to the screw hole 9 and is inserted into the screw hole 9. Since the shaft portion 8 is loosely fitted to the bearing hole 6, the distance between the base end of the case 28 of the antenna rod 24 and the axis of the shaft member 7 becomes short when the male screw shaft 25 is fastened. Accordingly, the drum 10 moves closer to the polyhedral faces 22 of the upper case 16. Consequently, the outer circumference of the drum 10 and the polyhedral faces 22 are contacted and fitted into each other tightly. Therefore, the drum 10 is locked and the rotation of the drum 10 is restricted. This restriction prevents the antenna rod 24 from being rotated around the axis of the shaft member 7 (see FIG. 2 and FIG. 4).

On the other hand, when the antenna rod 24 is rotated in the opposite direction around the axis thereof, the male screw shaft 25 is loosened and comes out from the screw hole 9. When the male screw shaft 25 is loosened, the distance between the base end of the case 28 of the antenna rod 24 and the axis of the shaft member 7 becomes long. Accordingly, the outer circumference of the drum 10 is separated from the polyhedral faces 22 of the upper case 16, and thus the outer circumference of the drum 10 and the polyhedral faces 22 are released from each other (see FIG. 3 and FIG. 5). Consequently, the drum 10 and the shaft member 7 can be rotated. That is, the antenna rod 24 can be in an upright position and a lying position around the axis of the shaft member 7. Hence, inclination of the antenna rod 24 can be adjusted.

Even though the male screw shaft 25 is loosened by rotating the antenna 24 around the axis thereof, the flange 27 is caught on the inner teeth 15 of the stopper ring 14. Therefore, the shaft 26 does not come out from the stopper ring 14. Since the stopper ring 14 is sandwiched between the inner face of the through hole 11 of the drum 10 and the shaft member 7, the stopper ring 14, the shaft 26 and the male screw shaft 25 do not come out from the insertion hole 12 of the drum 10. Hence, the antenna rod 24 is not removed.

After the male screw shaft 25 is loosened, the drum 10 and the shaft member 7 are rotated by moving the antenna rod from the upright position (see FIG. 3 and FIG. 5) to the lying position. Because the outer circumference of the drum 10 is separated from the polyhedral faces 22, the antenna rod 24 can be tilted smoothly.

When fastening the male screw shaft 25 after the antenna rod 24 is tilted backward by rotating the drum 10 by two faces of the polyhedral faces 22 from the upright position (see FIG. 3 and FIG. 5), the outer circumference of the drum 10 and the polyhedral faces 22 are contacted and fitted into each other tightly (see FIG. 6). Consequently, the rotation of the drum 10 is restricted, and thus the antenna rod 24 is locked.

The male screw shaft 25 may be fastened after the antenna rod 24 is tilted backward by rotating the drum 10 by one face of the polyhedral faces 22 from the upright position (see FIG. 3 and FIG. 5). In this case, the antenna rod 24 is locked in tilted condition.

Even when looseness of the male screw shaft 25 is small, the antenna rod 24 can be in an upright position and a lying position. In this case, when moving the antenna rod 24 between the upright position and the lying position, edge portions of the drum 10 deviate from edge portions of the polyhedral faces 22, and a click feeling may be obtained at that time. The click feeling may also be obtained when the edge portions of the drum 10 are fitted into the edge portions of the polyhedral faces 22 by rotating the drum 10. It is preferable that the drum 10 is made of a resin material because the edge portions of the drum 10 may easily be deformed.

A manufacturing method of the antenna apparatus 1 will be explained below.

First, the support member 3 is welded to the upper face of the plate 2 Next, the shaft member 7 and the stopper ring 14 are inserted into the through hole 11 of the drum 10 Then, the drum 10 is inserted between the pair of side boards 5, and the shaft portions 8 of the shaft member 7 are fitted into the bearing holes 6 of the support member 3. Next, the waterproof rubber 18 is attached to the bottom end of the hood 17, and the support member 3 is accommodated inside the hood 17. The opening at the lower part of the hood 17 is closed by the plate 2. Then, the screw 20 is fastened to the female screw cylinder 19 through the through hole 21. Then, the male screw shaft 25 is fastened to the screw hole 9 by passing the flange 27, the shaft 26 and the male screw shaft 25 through the hole 23, the insertion hole 12 and the screw hole 9. At that time, the flange 27 is contacted to the inner teeth 15 of the stopper ring 14. By further fastening the male screw shaft 25, the inner teeth 15 of the stopper ring 14 are deformed by pressing the inner teeth 15 by the flange 27, and the shaft 26 is inserted Into the stopper ring 14. Thus, the manufacture of the antenna apparatus 1 is completed.

When the antenna apparatus 1 is mounted on a position such as a roof of an automobile, the inside of the upper case 16 is sealed by closing the lower side of the upper case 16 with a bottom plate (not shown). The bottom plate is provided with a screw portion for mounting the antenna apparatus 1 on the automobile body, and the screw portion is inserted into a hole which is provided in the automobile body. The bottom plate is fastened and fixed to the roof and the like of the automobile by screwing a nut with the screw portion from the inside of the automobile body. In this manner, the antenna apparatus 1 is fixed to the roof of the automobile.

As described above, according to the embodiment, the inclination of the antenna rod 24 is determined by the fitting between the outer circumference of the drum 10 and the polyhedral faces 22 inside the upper case 16. Accordingly, the outer face of the upper case 16 does not have to be polyhedral faces and can be designed flexibly. In particular, since the outer face of the upper case 16 is curved, the exterior of the antenna apparatus 1 seems to be smooth. With this structure the design quality of the antenna apparatus 1 can be enhanced.

Moreover, the antenna rod 24 does not come out due to the stopper ring 14 to discourage theft.

The stopper ring 14 is sandwiched between the inner face of the drum 10 and the shaft member 7, and the shaft 26 passes through the stopper ring 14 so that the stopper ring 14 is fixed to the drum 10. Therefore, adhesive, a screw and the like are not needed for fixing the stopper ring 14 to the drum 10.

The present invention is not limited to the above-described embodiment. Various modification and design changes can be made without departing from the scope of the invention.

In the above-described embodiment, the shaft portion 8 of the shaft member 7 is loosely fitted to the bearing hole 6. The shaft portion 8 of the shaft member 7 may be fitted to the bearing hole 6. In this case, it is preferable that the bearing hole 6 is formed into a circular shape so that the shaft member 7 can be rotated. It is also preferable that the shaft portion 8 of the shaft member 7 or the periphery of the bearing hole 6 is made of a largely deformable material such as rubber so that the outer circumference of the drum 10 is contacted to or separated from the polyhedral faces 22 by fastening or loosening the male screw shaft 25. It is further preferable that the largely deformable material is conductive so that the shaft member 7 and the support member 3 are electrically connected.

According to one aspect of the preferred embodiment of the present invention, there is provided an antenna apparatus, including: a support member; a drum which is rotatably supported by the support member and whose outer circumference corresponds to faces of polygonal column; a case which covers the support member and the drum and which has a hole along a circumference direction of the drum; an antenna rod which extends from the outer circumference of the drum in a direction perpendicular to an axis of the drum toward an outside of the case through the hole of the case; and polyhedral faces which are provided inside the case and which are to be fitted into the outer circumference of the drum.

As described above, the outer circumference of the drum corresponds to the faces of polygonal column, the polyhedral faces are formed inside the case, and the polyhedral faces and the outer circumference are to be fitted into each other. With this structure, the drum and the antenna rod are supported. When the drum is rotated around the axis thereof, the edges of the outer circumference of the drum can be deviated from the edges of the polyhedral faces. Accordingly, the drum and the antenna rod can be rotated.

Further, since the polyhedral faces are formed inside the case, the external shape of the case can be designed flexibly.

Preferably, the support member has a bearing hole, the antenna apparatus further includes: a shaft member which is embraced by the drum and inserted into the bearing hole and which supports the drum rotatably with respect to the support member; a stopper ring sandwiched between the shaft member and an inner face of the drum; a screw shaft disposed to the antenna rod extending from an end of the antenna rod on the drum side; a shaft disposed to the screw shaft extending from a tip end of the screw shaft; and a flange disposed to the shaft, wherein the drum has an insertion hole penetrating the drum in the direction perpendicular to the axis of the drum, the shaft member has a screw hole penetrating the shaft member in a direction perpendicular to an axis of the shaft member, the screw hole and the insertion hole are arranged in a row, the stopper ring is sandwiched between the shaft member and the inner face of the drum at a periphery of the insertion hole, the screw shaft passes through the insertion hole and is to be screwed with the screw hole, the shaft passes through the stopper ring, and the flange is to be fixed by the stopper ring.

As described above, the flange can be fixed by the stopper ring, and the stopper ring is sandwiched between the inner face of the drum and the shaft member. With this structure, the screw shaft cannot be removed from the screw hole even when the screw shaft is loosened Therefore, the antenna rod cannot be detached to discourage theft.

Preferably, the shaft member is loosely fitted into the bearing hole.

As described above, the shaft member is loosely fitted into the bearing hole, the flange can be fixed by the stopper ring which is sandwiched between the inner face of the drum and the shaft member. With this structure, the drum becomes closer to the polyhedral faces together with the shaft member as the screw shaft is fastened to the screw hole. Accordingly, the outer circumference of the drum and the polyhedral faces are fitted into each other tightly, and thus the antenna rod and the drum can be supported. On the other hand, when the screw shaft is loosened, the drum is separated from the polyhedral faces, and the outer circumference of the drum and the polyhedral faces are not fitted into each other tightly. Therefore, the antenna rod and the drum can easily be rotated.

Thus, the external shape of the case can be designed flexibly.

The entire disclosure of Japanese Patent Application No. 2008-303713 filed on Nov. 28, 2008 including description, claims, drawings, and abstract are incorporated herein by reference in its entirety.

Although various exemplary embodiments have been s and described, the invention is not limited to the embodiments shown. Therefore, the scope of the invention is intended to be limited solely by the scope of the claims that follow.

What is claimed is:

1. An antenna apparatus, comprising:

a support member which has a bearing hole;

a drum which is rotatably supported by the support member and whose outer circumference corresponds to faces of a polygonal column;

a case which covers the support member and the drum and which has a hole along a circumference direction of the drum;

an antenna rod which extends from the outer circumference of the drum in a direction perpendicular to an axis of the drum toward an outside of the case through the hole of the case;

polyhedral faces which are provided inside the case and which are to be fitted into the outer circumference of the drum;

a shaft member which is embraced by the drum and inserted into the bearing hole of the support member, and which supports the drum rotatably with respect to the support member;

a stopper ring sandwiched between the shaft member and an inner face of the drum;

a screw shaft disposed to the antenna rod extending from an end of the antenna rod on the drum side;

a shaft disposed to the screw shaft extending from a tip end of the screw shaft; and a flange disposed to the shaft;

wherein:

the drum has an insertion hole penetrating the drum in the direction perpendicular to the axis of the drum;

the shaft member has a screw hole penetrating the shaft member in a direction perpendicular to an axis of the shaft member;

the screw hole and the insertion hole are arranged in a row;

the stopper ring is sandwiched between the shaft member and the inner face of the drum at a periphery of the insertion hole;

the screw shaft passes through the insertion hole and is configured to be screwed with the screw hole;

the shaft passes through the stopper ring; and the flange is configured to be fixed by the stopper ring.

2. The antenna apparatus according to claim 1, wherein the shaft member is loosely fitted into the bearing hole.

3. An antenna apparatus, comprising:

a support member;

a drum which is rotatably supported by the support member and whose outer circumference corresponds to faces of polygonal column;

an upper case which covers the support member and the drum and which has a hole along a circumference direction of the drum; and an antenna rod which extends from the outer circumference of the drum in a direction perpendicular to an axis of the drum toward an outside of the upper case through the hole of the upper case;

wherein the upper case comprises polyhedral faces which are provided on an inner face of the upper case and which match the outer circumference of the drum; and wherein rotation of the drum is prevented when the outer circumference of the drum closely engages the polyhedral faces.

* * * * *